US006949153B2

(12) United States Patent
Gomez de Segura et al.

(10) Patent No.: US 6,949,153 B2
(45) Date of Patent: Sep. 27, 2005

(54) PROCESS FOR THE "IN SITU" MANUFACTURING OF EXPLOSIVE MIXTURES

(75) Inventors: Fernando Beitia Gomez de Segura, Murguia (ES); José Ramón Quintana Angulo, Getxo (ES); Rafael Lanza Rivas, Las Arenas (ES)

(73) Assignee: Union Espanola de Explosivos S.A., Madrid (ES)

( * ) Notice: Subject to any disclaimer, the term of this patent is extended or adjusted under 35 U.S.C. 154(b) by 31 days.

(21) Appl. No.: 10/601,396

(22) Filed: Jun. 23, 2003

(65) Prior Publication Data

US 2004/0016481 A1 Jan. 29, 2004

(30) Foreign Application Priority Data

Jun. 26, 2002 (ES) ..... P200201474

(51) Int. Cl.[7] ..... D03D 23/00; F42D 3/00
(52) U.S. Cl. ..... 149/109.6; 102/313
(58) Field of Search ..... 102/313, 289; 86/20.15; 149/60, 108.8, 109.6

(56) References Cited

U.S. PATENT DOCUMENTS

| | | | | |
|---|---|---|---|---|
| 3,303,738 | A | 2/1967 | Clay et al. | |
| 3,338,033 | A | 8/1967 | Ross | |
| 3,400,026 | A | 9/1968 | Fearnow | |
| 3,507,718 | A | 4/1970 | Mortenson et al. | |
| 3,582,411 | A | 6/1971 | Brockbank et al. | |
| 3,610,088 | A | 10/1971 | Christianson et al. | |
| 3,678,140 | A | 7/1972 | Adams et al. | |
| 3,706,607 | A | 12/1972 | Chrisp | |
| 3,711,345 | A | 1/1973 | Tomic | |
| 3,713,919 | A | 1/1973 | Tomic | |
| 3,770,522 | A | 11/1973 | Tomic | |
| 3,790,415 | A | 2/1974 | Tomic | |
| 3,886,010 | A | 5/1975 | Thornley et al. | |
| 4,008,108 | A | 2/1977 | Chrisp | |
| 4,555,278 | A | 11/1985 | Cescon et al. | |
| 4,966,077 | A | 10/1990 | Halliday et al. | |
| 5,490,887 | A | 2/1996 | Cranney et al. | |
| 5,500,062 | A | 3/1996 | Chattopadhyay | |
| 6,537,399 | B2 * | 3/2003 | Gomez De Segura et al. | 149/109.6 |
| 6,610,158 | B2 * | 8/2003 | Lanza Rivas et al. | 149/109.6 |

FOREIGN PATENT DOCUMENTS

| | | |
|---|---|---|
| EP | 0194775 | 9/1986 |
| EP | 0203230 | 12/1986 |
| GB | 1215378 | 12/1970 |
| WO | WO 99/00342 | 1/1999 |

* cited by examiner

*Primary Examiner*—Aileen Felton
(74) *Attorney, Agent, or Firm*—John C. McMahon

(57) ABSTRACT

The manufacture is carried out in a continuous manner simultaneous to the filling of the shot holes, in a mixer, preferably a rotating mixer, wherein a water-based, non-explosive or low sensitivity matrix, an air bubble stabilizing agent, and optionally, an oxidant in granular form and a combustible material are mixed together. The nature of the water-based matrix, together with the use of an air bubble stabilizing agent, allows the incorporation of air during the mixing, regulating the density of the final product and acting on the variables of the process. On coming out of the mixer, the explosive is totally sensitized and has reached its final density, allowing for quality control before filling the shot hole. The process may be carried out on the explosives pumping truck, with compartments for the transportation of a water-based matrix, an oxidant in granular form, a combustible material and a gas bubble stabilizing agent.

14 Claims, 1 Drawing Sheet

PROCESS FOR THE "IN SITU" MANUFACTURING OF EXPLOSIVE MIXTURES

FIELD OF THE INVENTION

This invention falls within the category of industrial explosives for use in mining and public works. More specifically, it refers to an "in situ" manufacturing method for explosive mixtures with a watergel type, non-explosive water matrix, an air bubble stabilizing agent and optionally an oxidant or a mixture of an oxidant and a combustible material in granular form.

BACKGROUND OF THE INVENTION

The use of explosives in public and mining works is so common that today undertaking such activities without their use would be unthinkable. Given the nature of these products, the issue of safety as much in their handling as in their transportation to the place of use are very important and constitute the priority area in the research and development in this industry.

The market has evolved from the use of cartridge-packaged products, generally cap sensitive, to much less sensitive products that should be initiated with a booster. To facilitate transport the tendency is to manufacture or sensitize "in situ".

In reference to manufacturing "in situ", that is, in the truck used for the pumping of the explosives to the shot hole, the first patents are from IRECO (U.S. Pat. No. 3,303,738 and U.S. Pat. No. 3,338,033). These patents disclose the manufacturing inside the truck of a watergel type explosive through the dosage and mixture of a liquid solution of salts and oxidants with a solid material containing oxidizing and thickening salts. In U.S. Pat. No. 3,610,088 (IRECO) the same method is used as in the previous patents for the formation of watergel "in situ" and incorporates the simultaneous addition of air either by mechanical trapping or through the generation of a gas through a chemical reaction. The patent EP 0 203 230 (IRECO) describes a mixer composed of mobile and fixed blades that allow for "in situ" manufacturing of an water-in-oil emulsion-type explosive agent.

The principal drawback of these first generation "in situ" manufacturing techniques lies in the fact that they used oxidant salt solutions at a high temperature that had to be transported in perfectly heat-resistant tanks with a heat contribution. The complexity both of the factory truck and of the manufacturing operation required the presence of highly qualified personnel to guarantee the success of the operation.

With the advent of emulsions, the tendency moved towards transporting matrix emulsions classified as non-explosive and their sensitizing "in situ", by mixing with hollow microspheres or generating gas via a chemical reaction. One characteristic of the emulsions is that they cannot be handled once gasified, as this provokes the migration of the gas bubbles and, therefore, an increase in density. For this reason, the pumping and handling of the emulsion should be carried out before the gasification reaction occurs, just as described in U.S. Pat. No. 4,008,108. The principal drawback of this is the time lapse between filling the shot holes and reaching the final density, thus having no manoeuvring ability if the obtained density is not correct, possibly producing sensitizing errors or an incorrect distribution of explosives in the column of the shot hole.

Another alternative is to transport the original product and sensitize it in the mine using the mixture of low density nitrate particles or a blend of ammonium nitrate with oil (ANFO). U.S. Pat. No. 4,555,278 and EP 0 194 775 describe explosives of this kind formed from emulsions and watergels respectively. In this type of explosive, known as "heavy ANFO", the sensitization is due to the porosity of the granules of porous ammonium nitrate and the air occluded between the gaps thereof. These types of blends are not pumpable, the shot holes are loaded with spindles and its water resistance is limited. The nitrate particle content is generally higher than 50%, given the fact that for lower contents the density of the resulting blend is greatly increased once the liquid product fills the gaps, leading the mixture to loose initiation sensitivity. For nitrate particle contents of less than 50% the resulting product may generally be pumped and sensitization is carried out either before filling the shot holes with hollow microspheres or instead by generating gas once the shot holes have been filled through a chemical reaction.

The solution of patent WO 99/00342 (Unión Española de Explosivos S.A.) discloses a process and installation for the "in situ" sensitization of water-based explosives before loading the shot holes using a non-explosive watergel type matrix. Sensitization is carried out by blending dosed quantities of the matrix product with a gas and a stabilizer of the gas bubbles. Likewise, the patent application WO 01/04073 (Unión Española de Explosivos, S.A.) discloses the process for the "in situ" manufacturing of water based explosives before loading the shot holes from a watergel-type oxidant matrix with an oxygen balance greater than 14%, a combustible material, a gas and a gas bubble stabilizer.

The object of the invention is an "in situ" manufacturing procedure of water-based, pumpable blends of explosives, with an (i) non-explosive watergel-type matrix, (ii) an air bubble stabilizing agent and optionally (iii) an oxidant or blend of an oxidant and a combustible material in granular form and/or (iv) a liquid combustible material. The density of the final product can be regulated according to the conditions of the process. This process allows for the density to be controlled and, therefore, the quality of the explosive product, before filling the shot holes, thus avoiding sensitivity errors due to inadequate density. It also allows the energy of the resulting explosive product to be varied acting on the proportions of the explosive matrix and the oxidant or the blend of oxidant and combustible material in granular form.

DETAILED DESCRIPTION OF THE INVENTION

Figure 1:
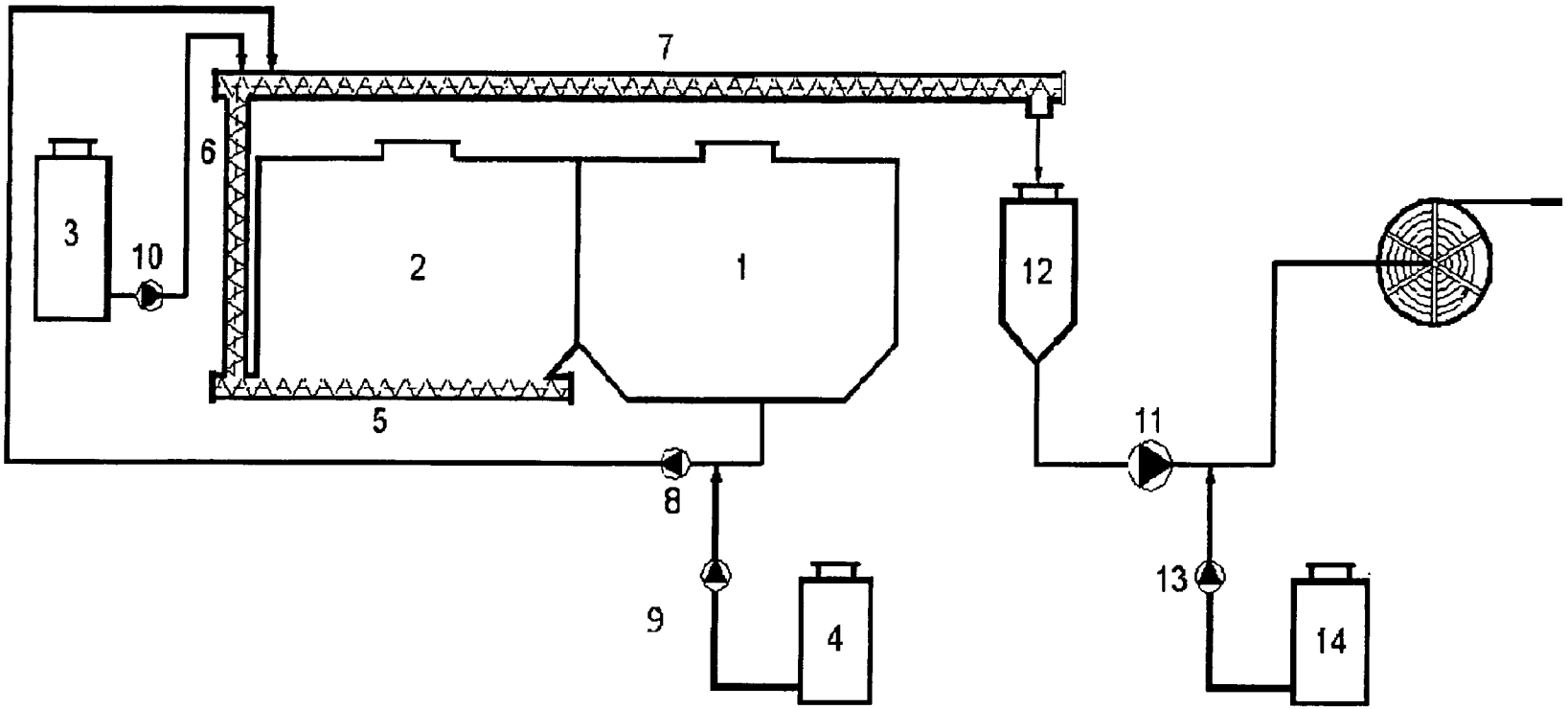
FIG. 1 shows a diagram of a particular embodiment of an installation for "in situ" manufacturing of explosive blends provided by this invention.

The invention provides a process for the continuous "in situ" manufacturing pumpable explosive mixtures, from here on process of the invention, that comprises:

a) transportation to the manufacture site:
   - (i) a low sensitivity, non-explosive matrix product comprising an aqueous solution or suspension of an oxidant salt, a thickening agent and, optionally, a combustible material and/or sensitizer;
   - (ii) an air bubble stabilizing agent, and optionally
   - (iii) an inorganic oxidant in granular form or a blend of an oxidant and a combustible material in granular form, and/or
   - (iv) a liquid combustible material b) blend said products (i), (ii), and optionally (iii) and/or (iv), in a device that allows the blending and collecting of atmospheric air in a controlled way, in order to obtain an explosive mixture with an oxygen balance of between −10% and +10%, that may be pumped, and with a density that may be adjusted to control quantity of air that is incorporated into said mixture; and c) load the resulting pumpable explosive mixture directly into the shot holes.

In the sense used in this description "manufacturing in situ" refers to the manufacturing of the explosive before loading the shot holes at the site at which they are to be used or at a nearby place, which means that the different components are mixed "in situ" in an installation that can be transported, for example, a truck, instead of in a fixed installation (factory manufacturing), generally at a significant distance from the site destined for the use of the explosive.

The non-explosive or low sensitivity matrix product, hereinafter referred to as the matrix product, is a water-based product comprised of water, an oxidant salt and a thickening agent. If wished, the said matrix product may also contain a combustible material and/or a sensitizer. The matrix product is transported to the "in situ" site of manufacture of the pumpable explosive blend in an adequate container such as a tank.

As oxidant salts, one can use nitrates, chlorates and perchlorates of ammonium, or alkaline metals or metals with a degree of alkalinity and mixtures thereof. More specifically, these salts may be, among others, the nitrates, chlorates and perchlorates of ammonium, sodium, potassium, lithium, magnesium, calcium and their mixtures. The total concentration of oxidant salts may vary between 30% and 90% of the weight of the matrix product, preferably between 40% and 75%.

For a thickening agent, the commonly used thickeners can be used in the manufacturing of this type of explosives, for example, products derived from seeds such as guar gum, galactomannan, biosynthetic products such as xanthan, starch, derivatives of products such as carboxymethylcellulose, synthetic polymers such as polyacrylamide, as well as mixtures of said products. The concentration of thickening agents may vary between 0.1% and 5% in weight of the matrix product, preferably between 0.5% and 2%.

The matrix product may, if desired, contain one or more combustible materials. The combustible materials that, optionally, are present in the matrix product may be either solid or liquid, for example, organic components belonging to the group made up of aromatic hydrocarbons, saturated or unsaturated aliphatic hydrocarbons, oils, petroleum derivatives, either of a vegetable origin such as starch, flours, sawdust, molasses and sugars or else finely divided metal combustible materials such as aluminium, silicon, ferrosilicon. The matrix product may optionally contain a mixture of the mentioned combustible materials. In general, the total concentration of the combustible material in the matrix product, if it contains a combustible material, weights between 1% and 20% of the total matrix product, preferably between 3% and 7%. Due to the fact that the pumpable explosive mixture obtained through the inventions procedure contains one or more combustible materials, if said combustible material or materials were not contained in the matrix product, it would be necessary to add them to the mixer. The pumpable explosive mixture's balance of oxygen obtained through the process of the invention is between −10% and +10%.

The matrix product contains, if desired, one or more sensitizers. The optional sensitizers that can be found may be those commonly used in the manufacturing of this type of water-based explosives. In a particular embodiment, said sensitizers may be alkylamine nitrates or, for example, methylamine nitrate, dimethylamine nitrate, etc., alkanolamine nitrates, for example, ethanolamine nitrate, diethanolamine nitrate, triethanolamine nitrate, etc., as well as other water-soluble amines such as hexamine, diethylentriamine, ethylenediamine, and their mixtures. In general, the total concentration of sensitizer in the matrix product, if it contains any, can be between 0.5% and 40% weight, preferably between 2% and 30%.

The matrix product may present in the pumpable explosive mixture obtained through the process of the invention in a wide concentration range, preferably in proportions higher than 50% in weight of the total mixture, preferably between 55% and 95% in weight.

As air bubble stabilizing agents, surfactant solutions or suspensions may be used, such as fatty acid amine derivatives, for example, amine lauryl acetate, etc., proteins, for example, ovalbumin, lactalbumin, collagen, modified guar gum of the hydroxypropyl type, etc., or mixtures of said products. The concentration of stabilizing agent may vary between 0.01% and 5% in weight, with respect to the total pumpable explosive mixture obtained by the process of the invention, preferably between 0.1% and 2%. The air bubble stabilizing agent should be transported to the pumpable explosive mixture's "in situ" site of manufacture in an adequate container, such as a tank.

The pumpable explosive mixture obtained through the process of the invention should contain, optionally, an inorganic oxidant in granular form or a mixture of oxidant and combustible material, in granular form. For inorganic oxidants in granular form, inorganic nitrates may be used, preferably ammonium nitrate. In some cases, the granular inorganic oxidant may be a porous ammonium nitrate, a standard product in the manufacturing of explosives.

In a particular embodiment, there may be the additional mixture of an inorganic oxidant and a combustible material, in granular form. In this case, an inorganic nitrate may be used as an inorganic oxidant, for example, granular ammonium nitrate. As a combustible material, either a liquid combustible material such as gas-oil etc., or a solid combustible material, such as granular aluminium or rubber, etc., may be used. In a particular embodiment, said mixture of inorganic oxidants and combustible materials in granular form, contains an inorganic nitrate in granular form and a liquid combustible material, in particular, a mixture of ammonium nitrate and gas-oil.

The concentration of inorganic oxidant in granular form, or of the mixture of oxidant and combustible material in granular form, in a pumpable explosive mixture is less than 50% with respect to the total mixture, preferably between 10% and 40% in weight.

The inorganic oxidant in granular form, or the mixture composed of inorganic oxidant and combustible material, in granular form, is transported to the "in situ" manufacturing site of the pumpable explosive mixture in an adequate container such as a tank.

The pumpable explosive mixture obtained through the process of the invention may optionally contain a liquid combustible material. This combustible material may be aromatic hydrocarbon, an aliphatic hydrocarbon, an oil, a petroleum derivative, a derivative of vegetable origin, or mixtures of said products. The concentration of liquid combustible material may vary between 0% and 20% in weight, preferably between 2% and 10% in weight in respect to the total pumpable explosive mixture obtained through the process of the invention. Where appropriate, the liquid combustible material, is transported to the pumpable explosive mixture's "in situ" manufacturing site in a suitable container, preferably a tank.

The mixing of the matrix product, the air bubble stabilizing agent, and, optionally, the inorganic oxidant in granular form or the mixture of inorganic oxidant and combustible material, in granular form and the liquid combustible material, is carried out in an appropriate mixer, such as rotating mixer (mixing machine), with the incorporation and trapping of atmospheric air. After mixing said components and the incorporation of air, a sensitized explosive mixture is obtained, with a balance of oxygen of between −10% and +10%, pumpable, with a density that can be adjusted by controlling the amount of air incorporated into said mixture. The nature of the matrix product, together with the use of an air bubble stabilizing agent, allows the incorporation of air during the mixing of the different components, regulating the density of the explosive mixture by acting on the variables in the process, for example, on the supply flow of the different components and/or on the speed the mixer rotates at. On coming out of the mixer, the explosive mixture is totally sensitized, and, having reached its final density, can be subjected to a quality control before filling the shot hole. The density of the pumpable explosive mixture obtained through the process of the invention may vary within a wide margin, advantageously between 0.7 and 1.4 g/cm$^3$, preferably, between 1.0 and 1.25 g/cm$^3$.

The explosive, sensitized mixture is sent, for example, by pump, directly to the shot holes, adding, if desired, a reticulating agent to improve water resistance. Among reticulating agents antimony components may be used such as potassium pyroantimoniate, antimonium and potassium tartrate, comprised of chromes such as chromic acid, sodium or potassium dichromate, composed of zirconium such as zirconium sulphate or diisopropylamine zirconium lactate, composed of titanium such as triethanolamine titanium chelate, composed of aluminium compounds such as aluminium sulphate, and its mixtures. The concentration of the reticulating agents, if added, may vary between 0.1% and 5% in weight, with respect to the pumpable explosive mixture obtained through the process of the invention, preferably being between 0.01% and 2%.

The process of the invention may be carried out in an explosives pumping truck, equipped with the necessary means, that has compartments for the transport of the said components (i)-(iv).

In a preferred, particular embodiment, the process of manufacturing water-based pumpable explosive mixtures "in situ", disclosed in this invention, is carried out in a shot hole transportation truck which has (see the diagram shown in FIG. 1):

- four tanks where the different components may be stored, specifically, a tank (1) for the non-explosive or low sensitivity matrix product, a tank (2) for the inorganic oxidant in granular form, a tank (3) for the liquid combustible material, and a tank (4) for the gas bubble stabilizer;
- a spindle (5) to dose the inorganic oxidant in granular form;
- a spindle (6) to take the inorganic oxidant in granular form to the mixer (7) of the rotating cement mixer type;
- a pump (8) to dose the matrix product;
- a pump (9) to dose the stabilizer;
- a pump (10) to dose the combustible material, respectively, into the mixer (7);
- a pump (11) that sucks from a hopper (12) to pump the pumpable explosive mixture (explosive product) to the bottom of the shot holes; and
- a pump (13) connected to a tank (14) in which a reticulant agent is stored.

The process for the "in situ" manufacturing of a pumpable explosive mixture provided by this invention has the advantage that it allows instantly varying the density of the explosive, thus allowing for the determination and control of the density of the explosive before filling the shot holes. At the same time, it also allows varying the proportions of the mixture adjusting its energy to the requirements of each application.

The invention is illustrated through the following example that is, in no way, restrictive.

EXAMPLE

The explosive products (pumpable explosive mixtures) described in this example are manufactured in an installation situated on a truck that consists of the following elements:

- a 8,000 l tank (1) where the non-explosive or low sensitivity, watergel-type (watergel matrix) matrix product (1) is stored;
- a 10,000 l tank (2) where the inorganic oxidant in granular form is stored;
- a 1,000 l tank (3) for the liquid combustible material;
- a tank (4) of 200 l for the storage of the stabilizing agent of air bubbles;
- a spindle (5) for the dosage of the inorganic oxidant in granular form;
- a spindle (6) to take the inorganic oxidant in granular form to the rotating mixer (7);
- three pumps (8,9 and 10) to take the watergel matrix, the air bubble stabilizing agent and the liquid combustible material, respectively, to the mixer (7);
- a pump (11) that sucks from a hopper (12) to pump the explosive product to the bottom of the shot holes; and
- a pump (13) connected to a tank (14) in which the reticulant agent is stored.

The tank (1) was filled with the formulation of watergel matrix described in Table 1:

TABLE 1

Composition of watergel matrix

| Component | % |
|---|---|
| Water | 11.9 |
| Ammonium nitrate | 78.0 |
| Methylamine nitrate | 9.5 |
| Guar gum | 0.6 |

This formulation is formed from an aqueous solution saturated in ammonium nitrate and methylamine nitrate, and by small particles of ammonium nitrate in suspension, this suspension being stabilized with guar gum. The density of the matrix mixture before stabilization in the mechanism described, was 1.50 g/cm$^3$.

The tanks, (2), (3) and (4) are filled with porous ammonium nitrate, gas-oil and an ovalbumin solution of 10% respectively.

Before starting the manufacturing tests the ammonium nitrate dose spindle (5) and the dose pumps of watergel matrix (8), gas-oil (10) and solution of air bubble stabilizing agent (9) were calibrated. The different manufacturing tests are carried out mixing in the rotating mixer (7): watergel matrix, ammonium nitrate, gas-oil and the solution of air bubble stabilizing agent. The density of the resulting product is adjusted via the flow of the different components and the speed of rotation of the mixer (7). In Table 2 the different manufacturing conditions and obtained density of each variant is shown:

TABLE 2

Operation conditions and density of explosive obtained

| Mixer r.p.m. | Watergel matrix kg/min | Ammonium Nitrate kg/min | Gas-oil l/min | Stabilizer kg/min | Density g/cm$^3$ |
|---|---|---|---|---|---|
| 250 | 150 | 0 | 5.6 | 1.5 | 1.22 |
| 350 | 150 | 0 | 5.6 | 1.5 | 1.08 |
| 400 | 150 | 0 | 5.6 | 1.5 | 0.95 |
| 400 | 300 | 0 | 11.2 | 4.0 | 1.18 |
| 350 | 150 | 50 | 9.4 | 2.5 | 1.12 |
| 350 | 150 | 100 | 13.3 | 3.0 | 1.17 |
| 400 | 150 | 130 | 15.6 | 3.5 | 1.15 |
| 400 | 100 | 80 | 10.0 | 2.3 | 1.02 |

As can be seen from Table 2, the value of the density may be adjusted by varying the speed of rotation of the mixer (7). Equally, by maintaining the rotation speed constant and varying the flow of the product, the density of the final explosive product may be regulated.

The explosive product, on coming out of the mixer (7), is pumped to the shot holes with a pump (11). To facilitate the pumping, the loading pipe is lubricated with a triathanolamine titanate reticulant solution in glycol that, upon mixing with the explosive product inside the shot hole, makes it more water resistant.

All the formulas tested detonated in 3", shot holes (7.62 cm), initiated with a 450 g pentolite booster, with a VOD of between 3,500 and 5,500 m/s.

What is claimed is:

1. A process for the continuous "in situ" manufacturing of pumpable explosive mixtures, comprising the steps of:

a) transporting to a place of manufacture the following ingredients:

(i) matrix product that is at least one of non-explosive and low sensitive; said product contains at least one of an aqueous solution and a suspension of an oxidant salt, and a thickening agent (ii) a stabilizing agent of air bubbles, b) mixing said product and said stabilizing agent in a tank by a rotating mixer that allows capturing of atmospheric air in a controlled way, to obtain a pumpable explosive mixture with an oxygen balance of between −10% and +10%, by controlling the amount of air that is incorporated into said explosive mixture; and c) loading the pumpable explosive mixture directly into a shot hole.

2. The process according to claim 1, wherein during the loading of the shot hole, the pumpable explosive mixture is mixed with a reticulating agent.

3. The process according to claim 1, wherein said matrix is present in an explosive mixture in a proportion greater than 50% of the total weight.

4. The process according to claim 1, wherein said stabilizing agent of air bubbles is selected from the group consisting of solutions and suspensions of surfactants, proteins and natural polymers and their derivatives.

5. The process according to claim 1, wherein the mixing is carried out in an installation assembled on a truck.

6. The process according to claim 1, wherein said product includes a combustible material.

7. The process according to calim 1, wherein said product includes a sensitizer.

8. The process according to claim 1, wherein said products includes a component selected from the group consisting of combustible materials, sensitizers and mixtures thereof.

9. The process according to claim 1, including the step of adding a liquid combustible material to the product.

10. The process according to claim 1, including the step of adding to the product a granular form component selected from the group consisting of inorganic oxidants in granular form, oxidants in granular form and mixtures thereof.

11. The process according to claim 10, wherein said granular from component is an inorganic nitrate in granular form.

12. The process according to claim 10, wherein said granular form component inorganic nitrated in granular form and including a liquid combustible material.

13. The process according to claim 9, wherein the liquid combustible material is selected from the group consisting of aromatic hydrocarbons, aliphatic hydrocarbons, oils, petroleum derivatives, derivatives of vegetable origin and mixtures thereof.

14. A process for the continuous "in situ"manufacturing of pumpable explosives mixtures, comprising:

a) transportation to place of manufacture of:

(i) a matrix product that contains a thickening agent, a combustible material, a sensitizer and at least one of an aqueous solution and a suspension of an oxidant salt;

(ii) a stabilizing agent of air bubbles, (iii) at least one of and inorganic oxidant in granular form and a mix formed of an oxidant and a combustible material, and (iv) a liquid combustible material;

b) mixing the components of paragraphs a in a tank that allows capturing of atmospheric air in a controlled way, to obtain a pumpable explosive mixture with an oxygen balance of between −10% and +10% , by controlling the amount of air that is incorporated into said explosive mixture; and c) loading the pumpable explosive mixture directly into a shot hole.

* * * * *